US011927384B2

(12) United States Patent
Koch et al.

(10) Patent No.: US 11,927,384 B2
(45) Date of Patent: Mar. 12, 2024

(54) REFRIGERATING APPLIANCE AND WATER OUTLET ARRANGEMENT FOR A REFRIGERATING APPLIANCE

(71) Applicant: BSH Hausgeraete GmbH, Munich (DE)

(72) Inventors: Alexander Koch, Neu-Ulm (DE); Rainer Weser, Gundelfingen (DE)

(73) Assignee: BSH Hausgeraete GmbH, Munich (DE)

( * ) Notice: Subject to any disclaimer, the term of this patent is extended or adjusted under 35 U.S.C. 154(b) by 87 days.

(21) Appl. No.: 17/629,938

(22) PCT Filed: Jul. 14, 2020

(86) PCT No.: PCT/EP2020/069865
§ 371 (c)(1),
(2) Date: Jan. 25, 2022

(87) PCT Pub. No.: WO2021/013633
PCT Pub. Date: Jan. 28, 2021

(65) Prior Publication Data

US 2022/0252327 A1 Aug. 11, 2022

(30) Foreign Application Priority Data

Jul. 25, 2019 (DE) ..... 102019211039.8

(51) Int. Cl.
*F25D 21/14* (2006.01)
*F25D 23/06* (2006.01)

(52) U.S. Cl.
CPC ..... *F25D 21/14* (2013.01); *F25D 23/061* (2013.01); *F25D 2321/143* (2013.01); *F25D 2321/146* (2013.01)

(58) Field of Classification Search
CPC ..... F25D 21/14; F25D 2321/143; F25D 2321/146; F25D 23/061
See application file for complete search history.

(56) References Cited

U.S. PATENT DOCUMENTS 8,122,733 B2 2/2012 Raab
8,899,070 B2 12/2014 Eckartsberg et al.
(Continued)

FOREIGN PATENT DOCUMENTS

CN 101558272 A 10/2009
CN 104344632 A 2/2015
(Continued)

OTHER PUBLICATIONS

English Language machine translation of JP2009042947 to Chomura. Entire document. Translated Jun. 2023. (Year: 2007).*
(Continued)

*Primary Examiner* — Cassey D Bauer
(74) *Attorney, Agent, or Firm* — Laurence A. Greenberg; Werner H. Stemer; Ralph E. Locher

(57) ABSTRACT

A refrigerating appliance, or household refrigerating appliance, includes a refrigerated goods container and a machine compartment having a wall facing the goods container, an insulating material region between the goods container and the machine compartment wall, and a water outlet arrangement conducting condensate from the goods container through the insulating material region and machine compartment wall into an evaporation container in the machine compartment. The water outlet arrangement has a trough-shaped wall region of the goods container oriented towards the machine compartment wall and extending funnel-like to a drip edge. A tube facility extends from the wall region through the insulating material region and an opening in the machine compartment wall into the machine compartment. A positioning device mutually positions the wall region and
(Continued)

tube facility, securing the drip edge radially in the tube facility and circumferentially spaced from an inner wall of the tube facility.

11 Claims, 6 Drawing Sheets

(56) References Cited

U.S. PATENT DOCUMENTS

| | | | | |
|---|---|---|---|---|
| 2009/0272139 | A1 | 11/2009 | Straface, Sr. et al. | |
| 2011/0107783 | A1* | 5/2011 | Bischofberger | F25D 21/14 62/291 |
| 2013/0139537 | A1* | 6/2013 | Kuijt | F25D 21/14 425/418 |

FOREIGN PATENT DOCUMENTS

| | | | |
|---|---|---|---|
| CN | 205300075 | U | 6/2016 |
| DE | 29501289 | U1 | 5/1996 |
| DE | 29715231 | U1 | 12/1998 |
| DE | 202006013228 | U1 | 10/2006 |
| DE | 202008007363 | U1 | 9/2008 |
| DE | 102015006912 | A1 | 9/2016 |
| JP | S54109658 | A | 8/1979 |
| JP | S61178179 | U | 11/1986 |
| JP | S6285887 | U | 6/1987 |
| JP | H1151549 | A | 2/1999 |
| JP | 2003114085 | A | 4/2003 |
| JP | 2009042947 | A | 2/2009 |
| RU | 2417345 | C2 | 4/2011 |
| RU | 2473851 | C2 | 1/2013 |
| WO | 2008025636 | A2 | 3/2008 |

OTHER PUBLICATIONS

English Language machine translation of JP2003114085 to Hashimoto et al. Entire document. Translated Jun. 2023. (Year: 2003).*

* cited by examiner a)

b)

c)

d)

a)

b)

c)

d)

REFRIGERATING APPLIANCE AND WATER OUTLET ARRANGEMENT FOR A REFRIGERATING APPLIANCE

FIELD AND BACKGROUND OF THE INVENTION

The invention relates to a refrigeration appliance, in particular a household refrigeration appliance, for example a refrigerator, and also a water outlet arrangement for a refrigeration appliance.

PRIOR ART

In the case of customary refrigeration appliances, condensation water that is collected in a refrigerated goods container of the refrigeration appliance is guided via a water outlet arrangement into an evaporation container that is located in a machine compartment, in which evaporation container said condensation is evaporated to the outside atmosphere.

During the operation of refrigeration appliances and freezers, due to the air humidity that is located in the cooling compartment, condensation water accumulates and must be drained through the insulation out of the appliance to the outside.

For this purpose, a water outlet component is attached to the refrigeration appliance inner container. It is necessary to ensure at the connecting site of the two components that no capillary action is able to occur, by means of which water could otherwise penetrate into the insulating material. The consequence would otherwise be an intense loss of the insulating effect and in certain circumstances a freezing of the water drain.

Furthermore, at the connecting site between the refrigerated goods container and the water drain it is necessary to ensure that no insulating material is able to penetrate into the water drain. For these requirements, it is necessary to maintain uniform defined gap sizes between the refrigerated goods container and water drain. It is therefore necessary to simultaneously provide a precise positioning and on the other hand a sufficiently large gap size.

This is to be achieved without the need to use complex and cost-intensive production methods such as for example welding the parts, applying adhesives and/or automated joining.

In the prior art, a water outlet (normally a plastic injection molded part) is attached to the refrigerated goods container. A known solution is disclosed in the utility model application CN 205300075 U.

In this case, the water outlet is not positioned in a precise manner near to the water outlet from the refrigerated goods container. A large gap is depicted to the left-hand side of the central axis and a very narrow gap is depicted to the right-hand side of said central axis. A precise positioning by the contour that is further remote from the outlet is difficult on account of the flat angle and the gap and it is possible for the positioning to be displaced by the foaming pressure during the customary foaming for the production of the insulation.

Nowadays, water outlet parts are bonded or welded to the refrigerated goods container and are often so long that they extend directly into the machine compartment. The sealing arrangement with respect to the refrigerated goods container is provided by adhesive bonding of hot glue, adhesive tapes or welding. The sealing arrangement against foam with respect to the machine compartment is provided either by adhesive tapes or by a sealing lip. In the case of the two solutions, space is required and must be accessible during the assembly. There is a risk of water leakage to the foam on account of parts that lie close to one another and the so-called capillary action. In addition, material expansions take place on account of different temperatures and put a strain on the adhesive connection. The joining direction and sequence of refrigerated goods container or water outlet and machine compartment is predetermined owing to the arrangement of the parts.

Owing to legal changes, it is necessary for plastic parts in the machine compartment to be produced from fireproof material. In this case, either metal or fireproof plastic is possible. In the case of metal parts, the design flexibility is limited, in the case of plastic parts made from fireproof material, the material selection is reduced and expensive. The processing tools and recycling are complex.

SUMMARY OF THE INVENTION

The present invention provides a refrigeration appliance, in particular a household refrigeration appliance, including:

- a refrigerated goods container and a machine compartment which has a machine compartment wall which is oriented toward the refrigerated goods container;
- an insulating material region which is disposed between the refrigerated goods container and the machine compartment wall; and
- a water outlet arrangement for guiding condensation water out of the refrigerated goods container through the insulating material region and through the machine compartment wall into an evaporation container disposed in the machine compartment;

wherein the water outlet arrangement has:

- a tub-shaped wall region, of the refrigerated goods container, oriented toward the machine compartment wall, the refrigerated goods container extending in a funnel-shaped manner as far as a drip edge;
- a tube facility which is connected to the wall region, into which tube facility the drip edge extends and which extends starting from the wall region through the insulating material region and through an opening of the machine compartment wall into the machine compartment; and
- a positioning facility which positions the wall region and the tube facility with respect to one another in such a manner that the drip edge is radially fixed in the tube facility and circumferentially spaced from an inner wall of the tube facility.

The present invention also relates to a water outlet arrangement for a refrigeration appliance, including;

- a tub-shaped wall region, of a refrigerated goods container, oriented toward the machine compartment wall, the refrigerated goods container extending in a funnel-shaped manner as far as a drip edge of the wall region;
- a tube facility which is connected to the wall region, into which tube facility the drip edge extends and which extends starting from the wall region through an insulating material region and through an opening of a machine compartment wall into a machine compartment; and
- a positioning facility which positions the wall region and the tube facility with respect to one another in such a manner that the drip edge is radially fixed in the tube facility and circumferentially spaced from an inner wall of the tube facility.

The idea underlying the present invention consists in providing a positioning facility which positions the wall region and the tube facility with respect to one another in such a manner that the drip edge is fixed radially in the tube facility and circumferentially spaced from an inner wall of the tube facility.

As a consequence, it is possible to ensure that the foam pressure of the insulating material cannot displace the water outlet arrangement on the upper end toward the refrigerated goods container and the occurrence of a disruptive capillary action is thereby prevented.

Preferred developments are the subject matter of the respective dependent claims.

In accordance with a preferred development, the positioning facility comprises a first surface contour region of the tube facility and a second surface contour region of the wall region, which are arranged above the drip edge and are connected to one another in a form-locking manner. This renders it possible to spatially separate the drip edge and the positioning facility, but nevertheless to attach said drip edge and the positioning facility near to one another on the refrigerated goods container and on the tube facility.

In accordance with a further preferred development, the positioning facility comprises a first spacing facility which has a plurality of ribs which are oriented radially starting from the inner wall into the interior of the tube facility and are arranged resting against an outer side of the wall region. This renders possible a simpler and more compact arrangement since no additional contours have to be provided on the refrigerated goods container and on the tube facility.

In accordance with a further preferred development, the plurality of ribs of the first spacing facility extends axially in the interior of the tube facility as far as the drip edge and said plurality of ribs are spaced on their upper side from the wall region. This further reduces the capillary action.

In accordance with a further preferred development, the positioning facility comprises a second spacing facility which has a plurality of ribs that are oriented in a curved manner starting from the inner wall into the interior of the tube facility and are arranged resting against an outer side of the wall region. This additionally provides an elastic tolerance compensation against thickness fluctuations of the refrigerated goods container, which simultaneously causes a self-centering effect.

In accordance with a further preferred development, the plurality of ribs of the second spacing facility extends axially in the interior of the tube facility to the drip edge and said plurality of ribs are spaced on their upper side from the wall region. This further reduces the capillary action.

In accordance with a further preferred development, the tube facility has a single tube. This minimizes the number of required components.

In accordance with a further preferred development, the tube facility has a first tube and a second tube, wherein the first tube extends in a funnel-shaped manner into the second tube as far as an inwardly oriented inclined edge of the first tube and wherein the positioning facility positions the wall region and the first tube with respect to one another in such a manner that the drip edge is fixed in the first tube and circumferentially spaced from the inner wall of the first tube. This simplifies or increases the flexibility of the assembly of the water outlet arrangement.

In accordance with a further preferred development, the first tube is produced from non-fireproof plastic and the second tube is produced from fireproof plastic or metal. This leads to a reduction in cost.

In accordance with a further preferred development, the second tube extends from the side of the machine compartment that is remote from the insulating material region into the machine compartment. This further simplifies the assembly.

In accordance with a further preferred development, the tube facility is adhesively bonded or screwed to the wall region. It is thereby possible to achieve a stable connection.

The described developments can be combined with one another in an arbitrary manner.

The present invention is explained further below with the aid of embodiments with reference to the attached figures.

DETAILED DESCRIPTION OF THE INVENTION

Identical reference signs in the figures of the drawings refer to identical or functionally identical elements, parts or components provided that the opposite is not disclosed.

Figure 1:
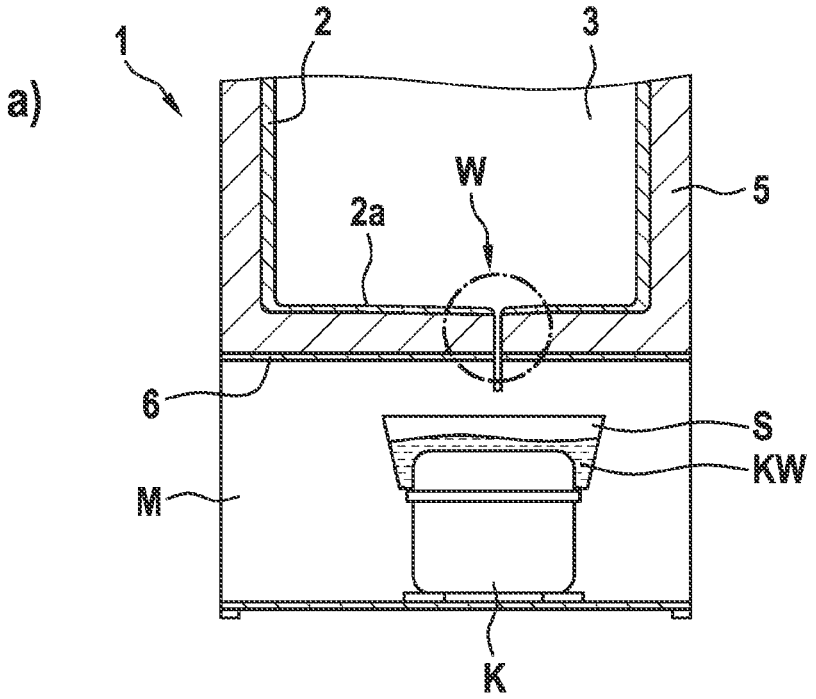
FIGS. 1*a*), *b*) shows schematic cross-sectional illustrations of a refrigeration appliance and a water outlet arrangement that is provided therein in accordance with a first embodiment of the invention.
Figure 1:
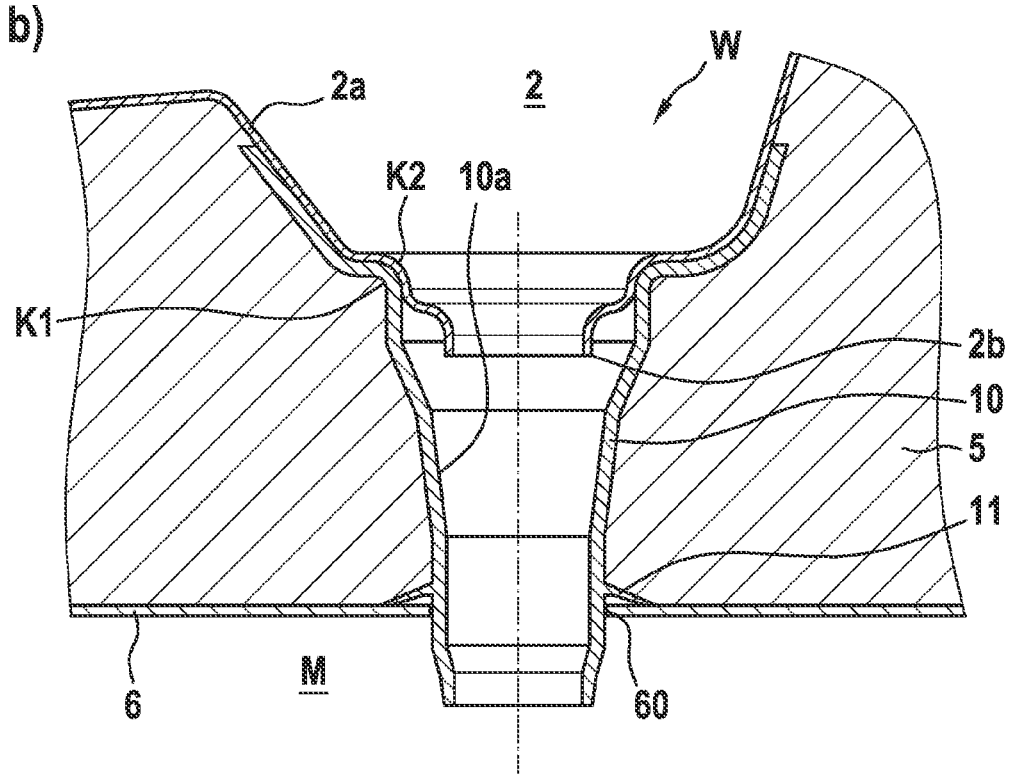

FIGS. 1*a*), *b*) shows schematic cross-sectional illustrations of a refrigeration appliance and a water outlet arrangement that is provided therein in accordance with a first embodiment of the invention.

The refrigeration appliance 1 that is illustrated in FIG. 1*a*), in particular a household refrigeration appliance, has a refrigerated goods container 2 that encompasses a refrigerating zone 3 for refrigerated goods.

Condensation water KW that is collected in the refrigerated goods container 2 of the refrigeration appliance 1 is guided via a water outlet arrangement W (only illustrated schematically in FIG. 1*a*)) into an evaporation container S that is located in a machine compartment M above a compressor K, in which evaporation container the condensation water KW is evaporated to the outside atmosphere.

The water outlet arrangement W that is illustrated in detail in FIG. 1*b*) guides the condensation water KW from the refrigerated goods container 2 through a tub-shaped wall region 2*a* of the refrigerated goods container 2, said wall region being oriented toward the machine compartment wall 6, through an insulating material region 5 and through a machine compartment wall 6 into the evaporation container S, wherein it is ensured by the embodiment of the water outlet arrangement W that no condensation water KW penetrates into the insulating material region 5.

The water outlet arrangement W in accordance with the first embodiment has a tub-shaped wall region 2*a*, of the refrigerated goods container 2, oriented toward the machine compartment wall 6, said refrigerated goods container extending in a funnel-shaped manner as far as a drip edge 2*b* of the wall region 2*a*.

A tube 10 which widens toward the wall region is connected to the wall region 2*a* by adhesive bonding, for example. The drip edge 2*b* extends into this tube 10.

The tube 10 extends over its length starting from the wall region 2*a* through the insulating material region 5 and through an opening 60 of the machine compartment wall 6 into the machine compartment M in order to guide the condensation water KW into the evaporation container S.

The wall region 2*a* and the tube 10 are positioned with respect to one another by means of a positioning facility K1, K2 in such a manner that the drip edge 2*b* is radially fixed in the tube 10 spaced circumferentially from an inner wall 10*a* of the tube 10. The positioning facility K1, K2 comprises a first, multi-curved surface contour region K1 of the tube 10 and a multi-curved second surface contour region K2 of the wall region 2*a*. The first and second multi-curved surface contour region K1, K2 are arranged above the drip edge 2*b* and are connected to one another in a form-locking manner.

The positioning facility K1, K2 that is designed in this manner consequently ensures that the drip edge 2*b* cannot be displaced by the foam pressure of the insulating material region 5 and is centered in the tube 10. Furthermore, it is ensured by the circumferential centering of the drip edge 2*b* with respect to the inner wall 10*a* that the capillary actions mentioned are suppressed.

In the region of the machine compartment wall, the tube 10 additionally has a spacing facility 11 which determines the distance of the machine compartment wall 6 to the wall region 2*a*.

In the case of the first embodiment, the drip edge 2*b* and the positioning facility K1, K2 are therefore spatially separated, but nevertheless are provided close to one another so that during assembly an exact positioning is ensured.

Figure 2:
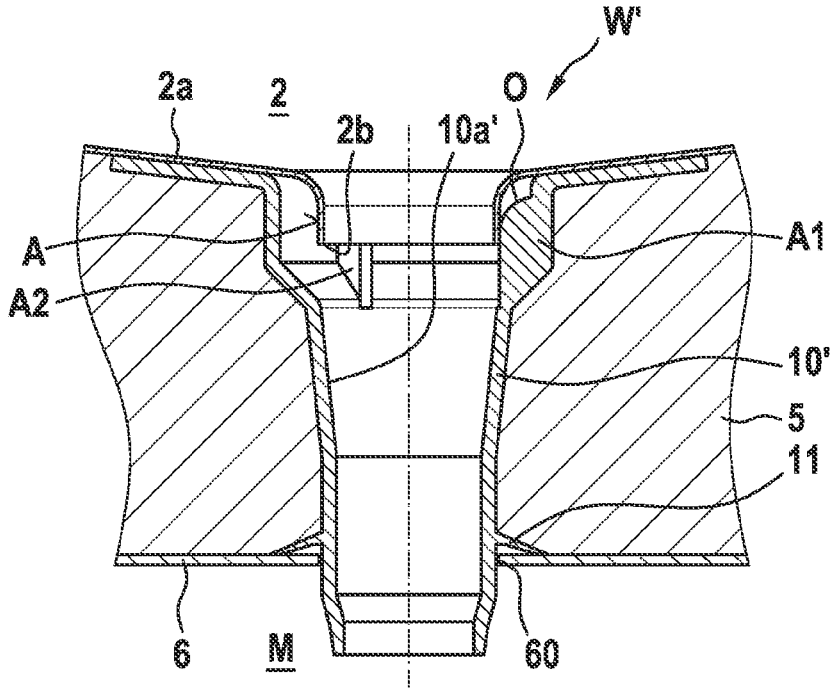
FIG. 2*a*)-*d*) shows schematic illustrations of a water outlet arrangement in accordance with a second embodiment of the invention and namely FIGS. 2*a*), *b*) in a cross section view and FIG. 2*c*) in a perspective view and FIG. 2*d*) in a plan view.
Figure 2:
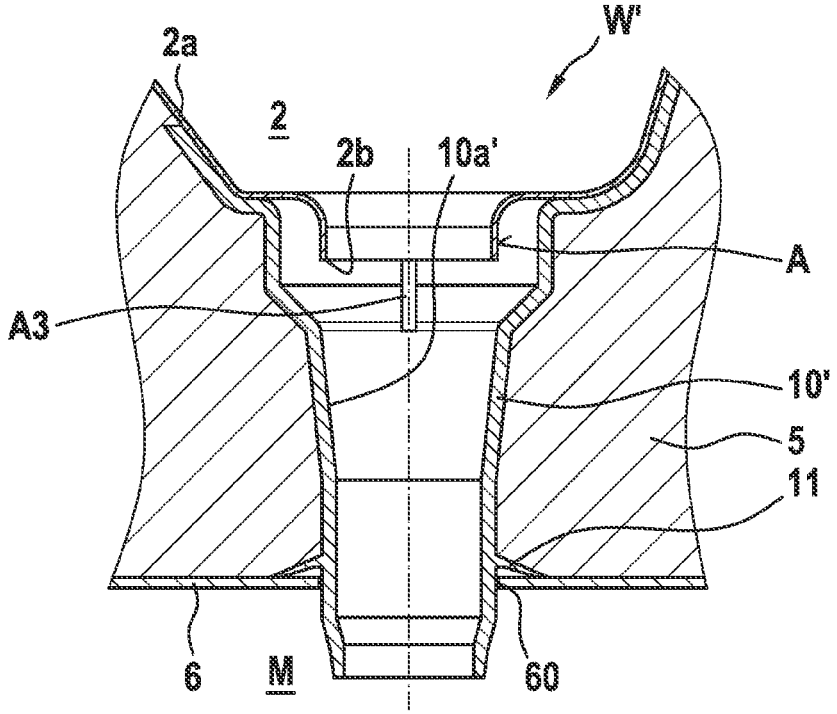
Figure 2:
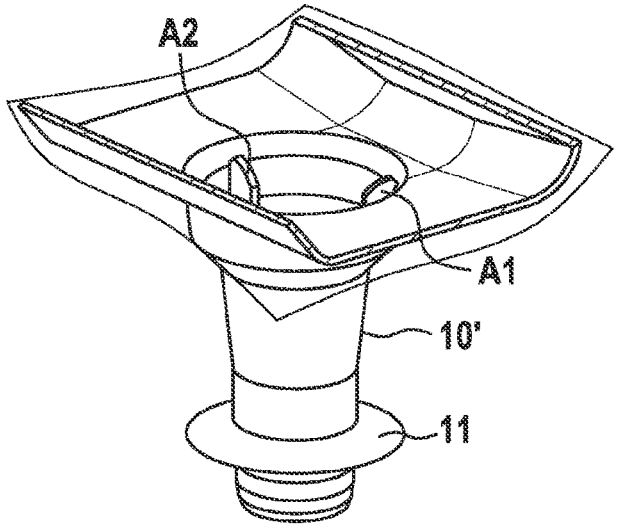
Figure 2:
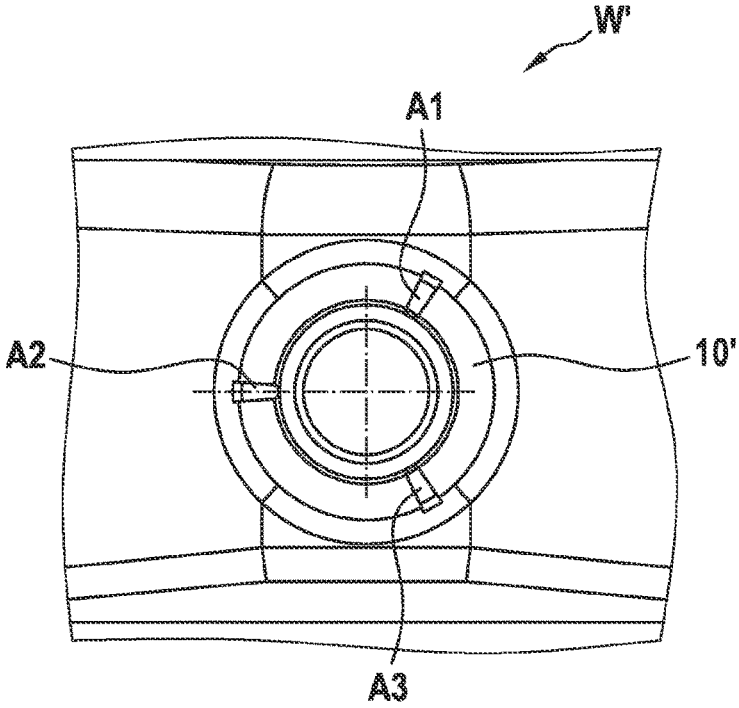

FIG. 2*a*)-*d*) illustrate schematic illustrations of a water outlet arrangement in accordance with a second embodiment of the invention, and namely FIGS. 2*a*), *b*) in a cross-sectional view and FIG. 2*c*) in a perspective view and FIG. 2*d*) in a plan view.

The water outlet arrangement W' in accordance with the second embodiment differs from the first embodiment in the design of the positioning facility A1, A2, A3 for the drip edge 2*b*.

A tube 10' which is connected to the wall region 2*a* and also the wall region 2*a* in the case of the second embodiment do not have repeatedly curved surface contour regions.

On the contrary, a spacing facility is provided as a positioning facility A1, A2, A3 and said spacing facility has a plurality of ribs A1, A2, A3 that are oriented radially starting from the inner wall 10*a*' of the tube 10' into the interior of the tube and are arranged resting against an outer side A of the wall region 2*a*.

The plurality of ribs A1, A2, A3 extend axially in the interior of the tube 10' as far as the drip edge 2*b* however said plurality of ribs are arranged spaced on their upper side O from the wall region 2*a*. This supports the prevention of the capillary action and renders possible a more compact design than in the case of the first embodiment since it is not necessary to perform any modifications in the form of repeatedly curved surface contour regions on the wall region 2*a* of the refrigerated goods container 2.

Apart from that, the second embodiment is constructed in a similar manner to the above-described first embodiment.

Figure 3:
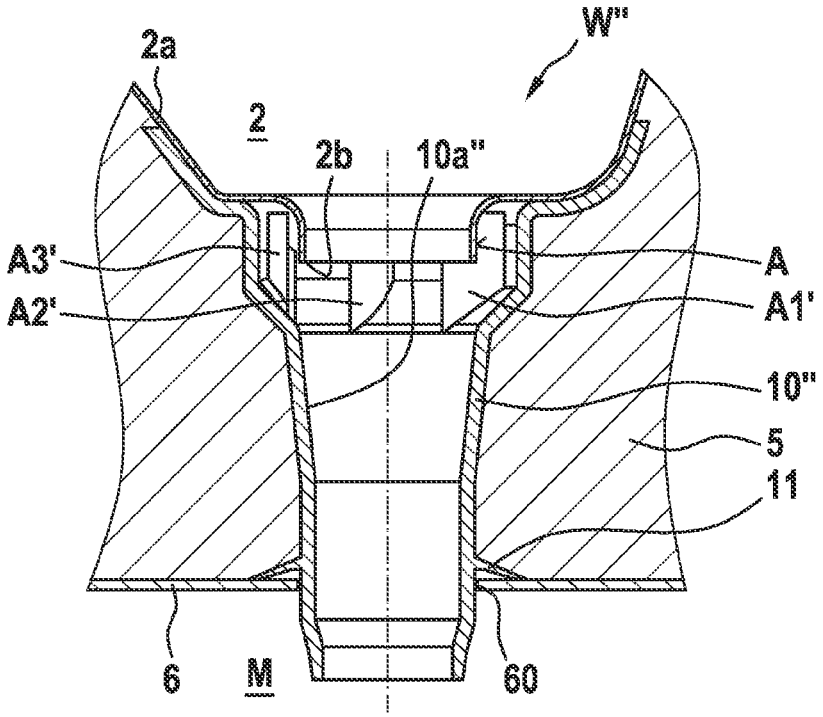
FIG. 3*a*)-*d*) shows schematic illustrations of a water outlet arrangement in accordance with a third embodiment of the invention, and namely FIGS. 3*a*), *b*) in a cross-sectional view and FIG. 3*c*) in a perspective view and FIG. 3*d*) in a plan view.
Figure 3:
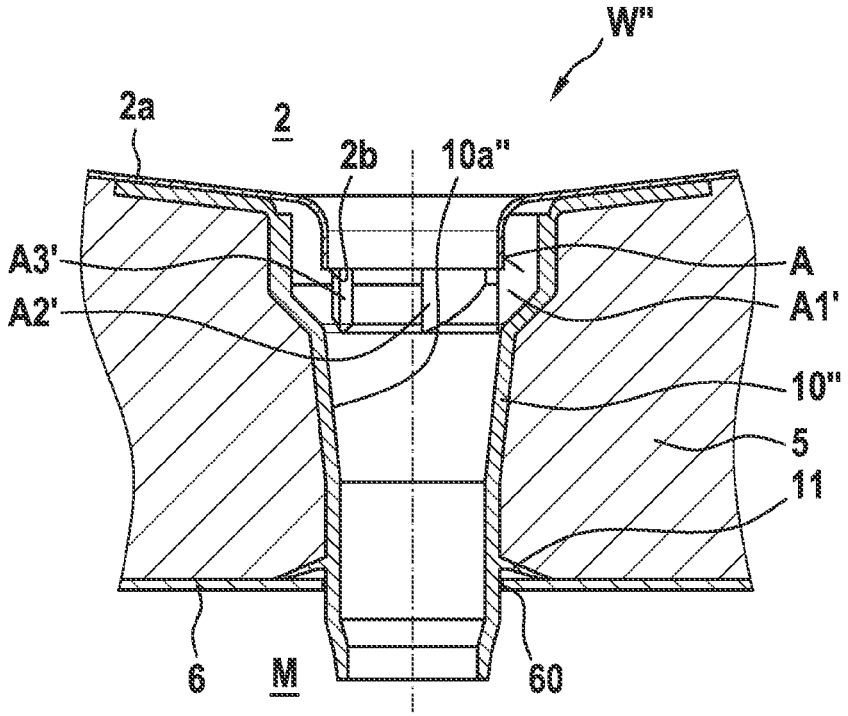
Figure 3:
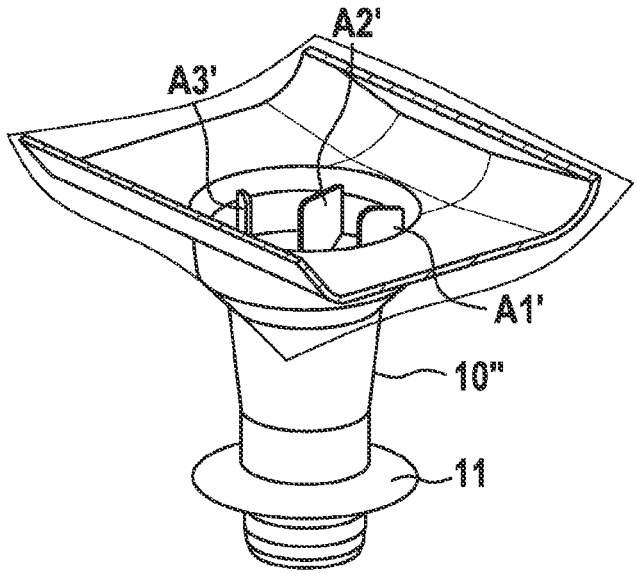
Figure 3:
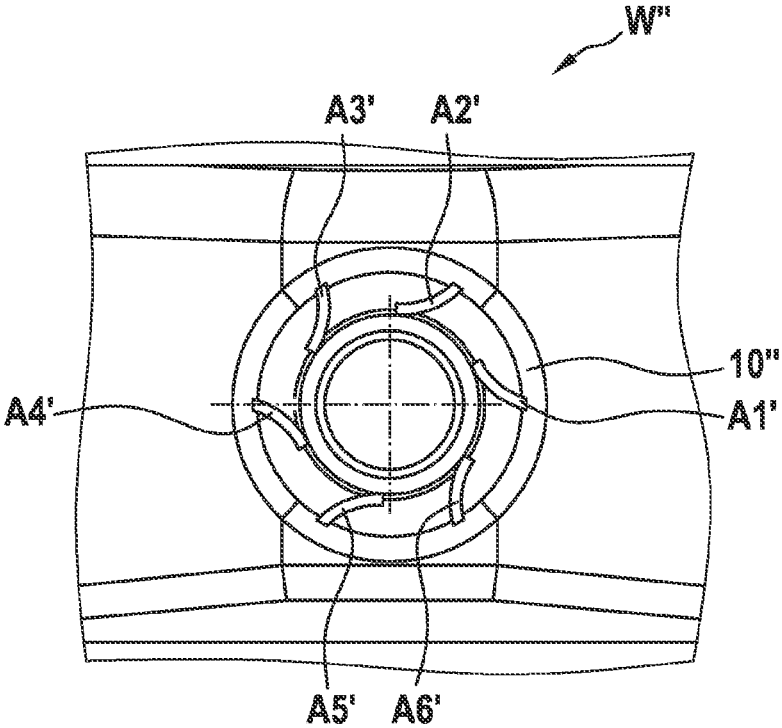

FIG. 3*a*)-*d*) illustrate schematic illustrations of a water outlet arrangement in accordance with a third embodiment of the invention and namely FIGS. 3*a*), *b*) in a cross-sectional view and FIG. 3*c*) in a perspective view and FIG. 3*d*) in a plan view.

The water outlet arrangement W" in accordance with the third embodiment likewise comprises a positioning facility A1'-A6' in the form of a spacing facility which comprises a plurality of ribs A1'-A6' which are however oriented in a curved manner starting from the inner wall 10*a*" into the interior of the tube 10" and are arranged resting against the outer side A of the wall region 2*a*.

In the case of this embodiment, the plurality of ribs A1'-A6' also extend axially in the interior of the tube 10" as far as the drip edge 2*b* and are spaced on their upper side O from the wall region 2*a*.

Moreover, an elastic tolerance compensation against thickness fluctuations of the shaped refrigerated goods container 2 is provided by the curvature of the ribs A1'-A6' and said elastic tolerance compensation simultaneously causes a self-centering effect.

Apart from that, the third embodiment is constructed in a similar manner to the above-described second embodiment.

Figure 4:
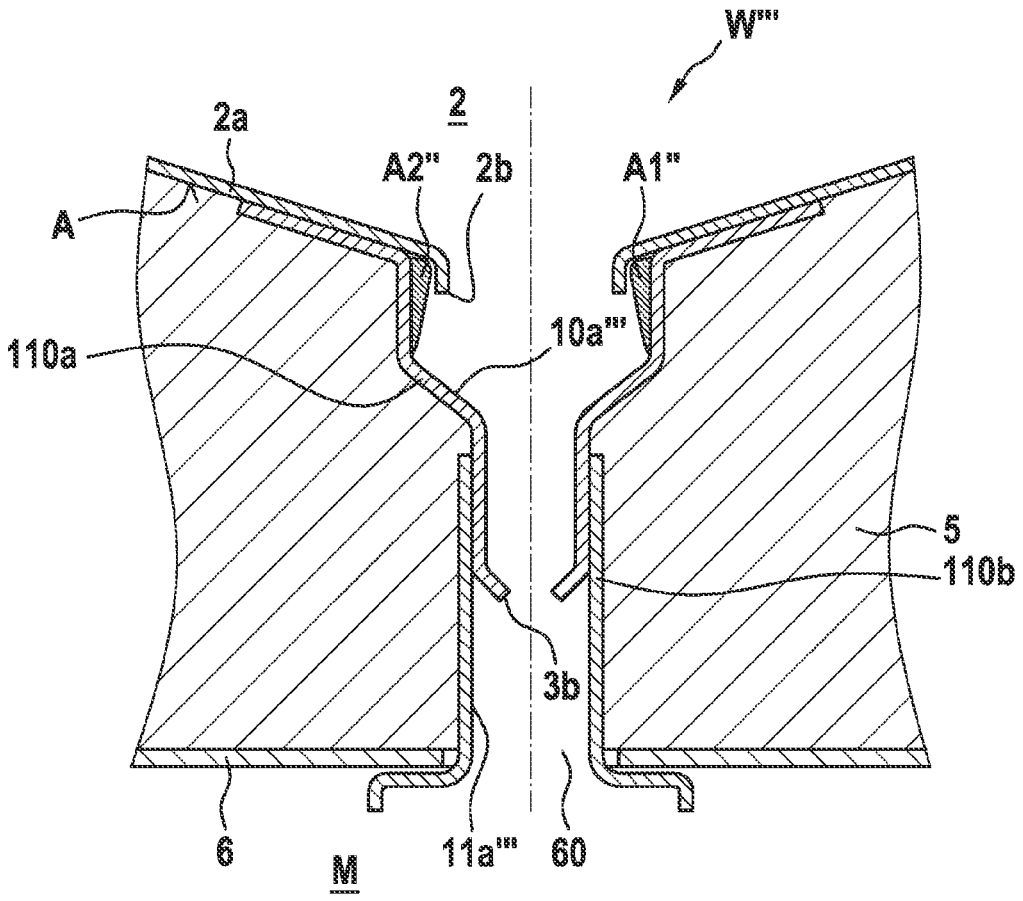
FIG. 4 shows a schematic cross-sectional illustration of a water outlet arrangement in accordance with a fourth embodiment of the invention.

FIG. 4 illustrates a schematic cross-sectional view of a water outlet arrangement in accordance with a fourth embodiment of the invention.

The water outlet arrangement W" in accordance with the fourth embodiment has a first tube 110*a* having a first inner wall 10*a*" and a second tube 110*b* having a second inner wall 11*a*'", wherein the first tube 110*a* extends in a funnel-shaped manner as far as an inwardly oriented inclined edge 3*b* of the first tube 110*a* to the second tube 110*b*.

The positioning facility A1", A2" is likewise a spacing facility having a plurality of ribs A1", A2" as is already described in connection with the second embodiment. Unlike the second embodiment, in the case of the fourth embodiment the ribs A1", A2" are arranged with their upper side O resting against the wall region 2*a*.

In the case of the fourth embodiment, with regard to the first and second tube 110*a*, 110*b* a material mix is realized, wherein the first tube 110*a* is produced from a non-fireproof plastic and the second tube 110*b* is produced from a fireproof plastic or metal.

Special adhesive bonding processes/welding processes are not required in the assembly of the refrigerated goods container 2. The inclined edge 3*b* of the first tube 110*a* is used simultaneously as a lead-in chamfer into the second tube 110*b*, which facilitates the assembly of the second tube 110*b* which is carried out in the case of the present embodiment on the part of the machine compartment M.

In the case of an accordingly selected insertion measure, the first tube 110*a* and the second tube 110*b* without further measures are sealed against the ingress of insulating material, for example insulating foam.

It is preferred that the first tube 110*a* is initially mounted on the refrigerated goods container 2 and the entire housing including the machine compartment M can subsequently be mounted without special joining requirements/sequences.

The second tube 110*b* can be mounted on the end and is fixed to the machine compartment wall 6 either using a bayonet fitting or by an adhesive bonding connection.

Since only the second tube 110*b* is produced from fireproof plastic or metal, a smaller quantity of material of this type is required.

The two-component design of the first and second tube 110*a*, 110*b* furthermore allows more design freedom for the remaining parts.

Apart from that, the fourth embodiment is constructed in a similar manner to the above-described second embodiment.

Although the present invention has been described above with the aid of preferred exemplary embodiments, said invention is not restricted thereto but can rather be modified in a variety of ways. In particular, the invention can be amended or modified in various ways without departing from the core of the invention.

For example, a shape, a dimension or a geometry of the components can be modified in an arbitrary manner.

The invention claimed is:

1. A refrigeration appliance or household refrigeration appliance, comprising:

a refrigerated goods container extending in a funnel shape to a drip edge, said refrigerated goods container having a tub-shaped wall region;

a machine compartment having a machine compartment wall oriented toward said refrigerated goods container and an evaporation container disposed in said machine compartment;

an insulating material region disposed between said refrigerated goods container and said machine compartment wall; and a water outlet arrangement for guiding condensation water out of said refrigerated goods container, through said insulating material region and through said machine compartment wall into said evaporation container, said water outlet arrangement including:

said tub-shaped wall region being oriented toward said machine compartment wall;

a tube facility into which said drip edge extends, said tube facility being connected to said tub-shaped wall region and having an inner wall, said tube facility starting from said tub-shaped wall region and extending through said insulating material region and through an opening in said machine compartment wall into said machine compartment; and a positioning facility positioning said tub-shaped wall region and said tube facility relative to one another, said positioning facility radially fixing said drip edge in said tube facility and circumferentially spacing said drip edge from said inner wall of said tube facility;

said positioning facility including a first spacing facility having a plurality of ribs oriented radially starting from said inner wall, extending into an interior of said tube facility and resting radially against an outer side of said tub-shaped wall region.

2. The refrigeration appliance according to claim 1, wherein said positioning facility includes a first surface contour region of said tube facility and a second surface contour region of said tub-shaped wall region, said surface contour regions being disposed above said drip edge and being form-lockingly connected to one another.

3. The refrigeration appliance according to claim 1, wherein said plurality of ribs extends axially in said interior of said tube facility to said drip edge, and said plurality of ribs has an upper side spaced from said tub-shaped wall region.

4. The refrigeration appliance according to claim 1, wherein said positioning facility includes a second spacing facility having a plurality of ribs oriented in a curved manner starting from said inner wall, extending into an interior of said tube facility and resting against an outer side of said tub-shaped wall region.

5. The refrigeration appliance according to claim 4, wherein said plurality of ribs extends axially in said interior of said tube facility to said drip edge, and said plurality of ribs has an upper side spaced from said tub-shaped wall region.

6. The refrigeration appliance according to claim 1, wherein said tube facility includes a single tube.

7. The refrigeration appliance according to claim 1, wherein:

said tube facility includes a first tube and a second tube;

said first tube extends into said second tube in a funnel shape to an inwardly oriented inclined edge of said first tube; and said positioning facility positions said tub-shaped wall region and said first tube relative to one another and fixes said drip edge in said first tube to be circumferentially spaced from said inner wall of said first tube.

8. The refrigeration appliance according to claim 7, wherein said first tube is formed of non-fireproof plastic and said second tube is formed of fireproof plastic or metal.

9. The refrigeration appliance according to claim 7, wherein said second tube extends from a side of said machine compartment wall being remote from said insulating material region into said machine compartment.

10. The refrigeration appliance according to claim 1, wherein said tube facility is adhesively bonded or screwed to said tub-shaped wall region.

11. In a refrigeration appliance including a machine compartment, an insulating material region and a refrigerated goods container extending in a funnel shape to a drip edge, a water outlet arrangement for the refrigeration appliance, the water outlet arrangement comprising:

a tub-shaped wall region of the refrigerated goods container oriented toward the machine compartment;

a tube facility into which the drip edge extends, said tube facility having inner wall and being connected to said tub-shaped wall region, said tube facility starting from said tub-shaped wall region and extending through the insulating material region and through an opening in a wall of the machine compartment into the machine compartment; and a positioning facility positioning said tub-shaped wall region and said tube facility relative to one another, radially fixing the drip edge in said tube facility and circumferentially spacing the drip edge from said inner wall of said tube facility;

said positioning facility including a spacing facility having a plurality of ribs oriented radially starting from said inner wall, extending into an interior of said tube facility and resting radially against an outer side of said tub-shaped wall region.

* * * * *